United States Patent [19]

Buttitta et al.

[11] Patent Number: 4,628,553

[45] Date of Patent: Dec. 16, 1986

[54] INFANT BED HYDRAULIC TILT MECHANISM

[75] Inventors: Anthony D. Buttitta, Sun Prairie; Douglas D. Garden, Barneveld, both of Wis.

[73] Assignee: The BOC Group, Inc., Montvale, N.J.

[21] Appl. No.: 715,714

[22] Filed: Mar. 25, 1985

[51] Int. Cl.[4] ..... A61G 7/10

[52] U.S. Cl. ..... 5/62; 5/66; 248/161; 254/3 C

[58] Field of Search ..... 5/60, 62, 63, 66, 68; 248/161, 162.1, 291, 292.1, 561, 631; 254/3 C

[56] References Cited

U.S. PATENT DOCUMENTS

| | | | |
|---|---|---|---|
| 3,640,520 | 2/1972 | Wieland et al. | 5/62 X |
| 3,880,465 | 4/1975 | Scheben | 248/161 X |
| 4,006,499 | 2/1977 | Young | 5/62 |
| 4,361,916 | 12/1982 | McDaniel | 5/66 X |

*Primary Examiner*—John E. Murtagh
*Assistant Examiner*—Richard Chilcot
*Attorney, Agent, or Firm*—Roger M. Rathbun; Larry R. Cassett

[57] ABSTRACT

An infant care center that includes a standing, vertical frame and has an infant bed that is suspended outwardly from the vertical frame. The infant bed is adapted to retain the infant and is readily adjustable to a plurality of positions devised for the infant. The bed itself is tiltable about an axis to the various positions and a unique tilt mechanism allows the degree of tilt to be easily selected and then locked into position by attending personnel. The tilt mechanism includes a double acting piston assembly that secures the frame to a point on the infant bed remote from the axis about which the bed is tiltable. The double acting piston assembly includes a piston operable within a cylinder and which divides the cylinder into two variable chambers. Each chamber has a part to introduce and remove hydraulic fluid therefrom and a closed circuit joins the parts so that fluid normally can move from one chamber to the other or the piston travels within the cylinder to move the tilt position of the infant bed. A valve is conveniently located for such personnel to open or close the closed circuit to the flow of hydraulic fluid such that when the valve is open, the infant bed may be moved to the desired position and the valve then closed to prevent further movement of the piston and therefore the infant bed is locked into that desired position.

5 Claims, 4 Drawing Figures

INFANT BED HYDRAULIC TILT MECHANISM

BACKGROUND OF THE INVENTION

The present invention relates to infant care centers of the type that provide a support or bed for the infant and which provide care facilities to that infant.

As an example of such infant care centers, it is normal to provide overhead heating units for warmth to the infant, as well as more complex centers where phototherapy may be used for bilirubin therapy and equipment may include oxygen availability, suction or monitoring instruments for attending to the infant.

One of the desirable features of such centers is that the infant bed be adjustable to different positions so that the infant can be retained in a generally horizontal orientation or can be moved to the Fowler position or Trendelenberg position to counteract physiological deficiencies.

Various means have been employed to allow tilt adjustment of the beds in infant care centers, including tilt mechanisms that feature discreet steps in which the bed is tilted to certain angles and some keying mechanism utilized to retain the bed at the desired angle. Other mechanisms have included single acting air spring pistons that are locked into the desired position by mechanical locks.

The present tilt mechanisms have certain deficiencies, however, in that one desirable feature is to have the infant bed tiltable to any number of positions within the defined limits; that is, the attending personnel have a great variety of positions that may be chosen and not just a few that are preselected by the manufacturer of the care center.

In addition, an important consideration is the ease of adjustment. Because personnel attending to infants already are normally quite busy with their principal concern, the infant, the tilt adjustment should be extremely easy and convenient to operate so that the desired tilt angle can be achieved without diverting the attention of such personnel to any real extent from the infant. Thus the controls are best suited to being in a readily accessible location and also be positive in action, that is, once the desired tilt angle is set, the personnel must be reasonably assured that such angle is maintained in that location quickly and surely and without fear of a quick movement or slippage in the locking mechanism.

SUMMARY OF THE INVENTION

The infant care center of the present invention has generally a freestanding frame from which is suspended an infant bed. The infant bed is pivotedly mounted to the frame such that it tilts about an axis to the degree necessary to reach the amount of tilt for Folwer or Trendelenberg positions. The tilting mechanism includes a double acting piston assembly constructed such that one end is affixed to the frame and the other end is affixed to the tiltable infant bed at a point displaced from the axis about which the bed is pivotable. By therefore extending or retracting the piston, the infant bed is tilted to various desired positions.

The double acting piston assembly is a commercially available hydraulic unit and which generally comprises a cylinder within which is a piston that is moveable and, of course, which also controls the movement of the piston rod that extends from one end of the cylinder. The piston separates a pair of variable chambers within the cylinder and which chambers are filled with hydraulic fluid and each chamber has a port for allowing hydraulic fluid to pass into and out from each chamber.

In the present invention a closed fluid circuit joins the ports such that as the piston moves, one chamber decreases in volume as the other increases. The hydraulic fluid thus passes through the closed fluid circuit from the decreasing chamber into the increasing chamber.

A valve is used to control the passage of hydraulic fluid through the closed circuit such that the operator can open the valve to allow fluid to pass through the closed circuit to enable the tiltable bed to be adjusted to any desired tilt angle within the maximum angular limits.

When the desired tilt angle is achieved, the operator merely releases the conveniently located, spring biased valve such that the valve prevents further passage of hydraulic fluid through the closed circuit.

Since the hydraulic fluid can thus neither leave nor enter either of the chambers in the cylinder, the piston remains in the desired fixed position holding the tiltable infant bed in that particular angle of tilt.

Thus, with a single valve operation, the tiltable bed can be adjusted to any number of positions of tilt and is not limited to certain discrete positions. The valve itself can conveniently be located as to be within easy access by the user so as to be least disruptive of the user's attention. Further, the valve is biased toward the closed position so that the operator can readily open the valve by movement of a valve operator, upwardly or downwardly, to move the infant bed to the desired tilt angle and then merely release the valve to retain the infant bed in the selected position.

DESCRIPTION OF THE PREFERRED EMBODIMENT

Figure 1:
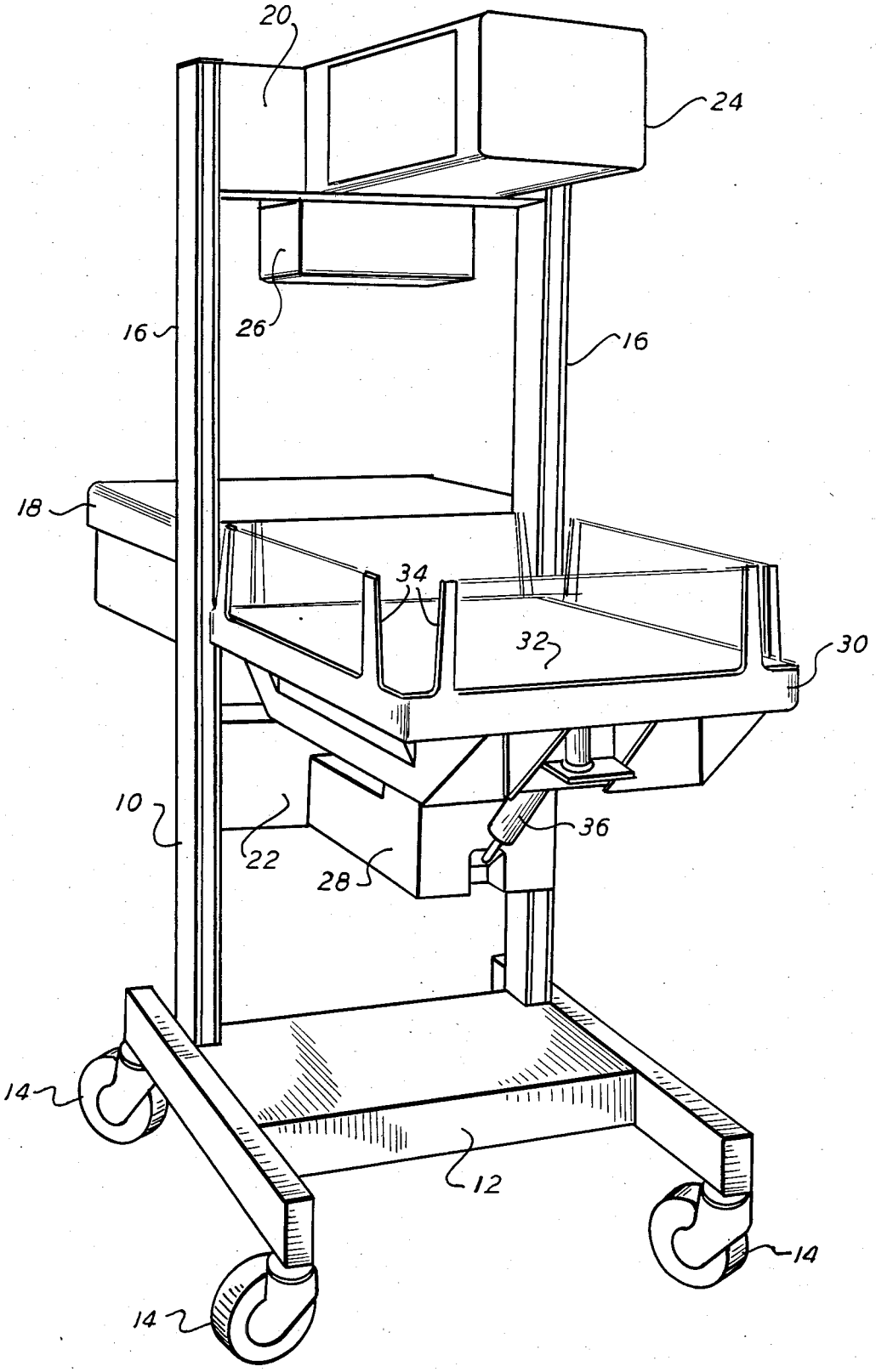
FIG. 1 is an isometric view of an infant care center having the tilt mechanism of the present invention.

Referring now to FIG. 1, there is shown an isometric view of an infant care center having a tilt mechanism constructed in accordance with the present invention. As shown, the care center includes a frame 10 which provides a freestanding unit for the care center. The frame 10 has a base 12 having wheels 14 so that the care center is easily movable. A pair of vertical struts 16 are mounted upon base 12 and which provide a means to support other structural parts such as a shelf 18 which may include a drawer for containing items needed for attending to an infant. The frame 10 also includes upper and lower cross-members 20 and 22, respectively. The upper cross-member 20 also supports other equipment, typically a heater 24 and a control module 26 having various controls to operate the care center.

Depending outwardly from lower cross-member 22 is a bed support 28 shown as a cantilever construction and which is the main support bearing the weight of the infant bed 30, as will be later explained.

The infant bed 30 has a flat upper surface 32 upon which the infant lies and which is surrounded by guards 34, generally of a clear plastic material and which contain the infant on the upper surface 32. Generally the guards 34 are releasable and/or removable for complete access to the infant.

Figure 2:
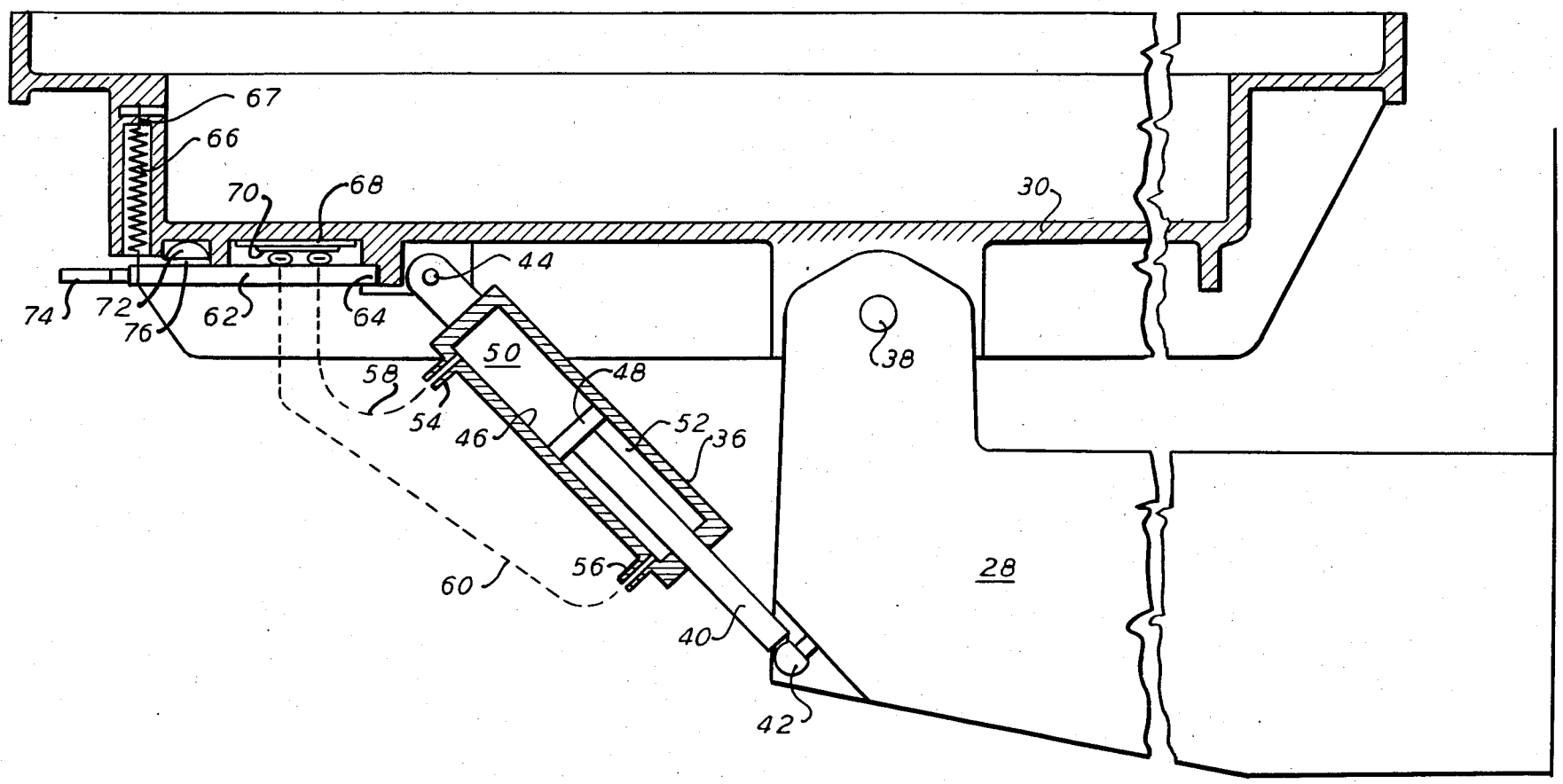
FIG. 2 is an enlarged view of the tilt mechanism of the present invention.

Turning to FIGS. 1 and 2, a piston assembly 36 is interconnected between the bed support 28 and the infant bed 30. In FIG. 2 in particular, the infant bed 30 can be seen supported by bed support 28 by means such as a pin 38. Only one pin 38 is shown in the FIG. 2, but generally a plurality of such pins can be provided, or other conventional means utilized such that the infant bed 30 is pivotably mounted to the bed support 28 and therefore tilts about an axis at the pivot point.

Piston assembly 36 is thus interconnected by having one end affixed to the bed support 28 and its other end affixed to the infant bed 30 at a point remote from the axis about which the infant bed pivots, shown as pin 38.

In the preferred construction, the piston rod 40 extending outwardly from the piston assembly 36 is affixed to the bed support 28 by a ball joint connection 42 to allow a certain flexibility. The other end of piston assembly 36 is affixed to the infant bed 30 by another pin 44.

The piston assembly 36 is a double acting hydraulic piston of conventional manufacture and comprises a cylinder 46 within which moves the piston 48 from which extends the piston rod 40.

The piston 48 separates cylinder 46 into a pair of variable chambers 50 and 52.

Ports 54 and 56 communicate with each of the variable chambers 50 and 52 respectively and, as will later be explained, convey hydraulic fluid to and from each of variable chambers 50 and 52 as the tilting mechanism is operated.

As shown as dotted lines in FIG. 2, hydraulic lines 58 and 60 connect to ports 54 and 56 respectively for carrying the hydraulic fluid through a closed circuit, as will be later explained.

A valve means is provided to control the flow of hydraulic fluid in the closed circuit and, accordingly, to control the moveability of the piston 48 within cylinder 46.

The valve means is preferably located at the front of the infant bed 30 so as to be convenient for the operator. As shown in FIG. 2, the valve means comprises a rod 62 that is pivoted at its one end 64 at the under side of the infant bed 30 and its free end is biased by spring 66. The upper end of spring 66 is fixed to the infant bed 30 by pin 67 and its lower end is affixed to the free end of the rod 62 to exert an upward bias against that free end.

The upward bias of spring 66 exerted against the free end of rod 62 acts, in cooperation with plate 68 to close off both hydraulic lines 58 and 60 which are sandwiched between rod 62 and plate 68. Plate 68 has a rounded projection 70 on the underside thereof that facilitates the pinching of the hydraulic lines 58 and 60 to insure that both are fully closed.

The valve means further comprises a cylindrical operator 72 having an operating lever arm 74 extending outwardly therefrom. The cylindrical operator 72 and lever arm 74 may be constructed as one molded part. In FIG. 2 the rod 62 is shown resting against a recess 76 formed in cylindrical operator 72 and in such position, the valve means is in its closed position pinching closed both hydraulic lines 58 and 60 preventing the flow of hydraulic fluid therethrough.

Figure 3:
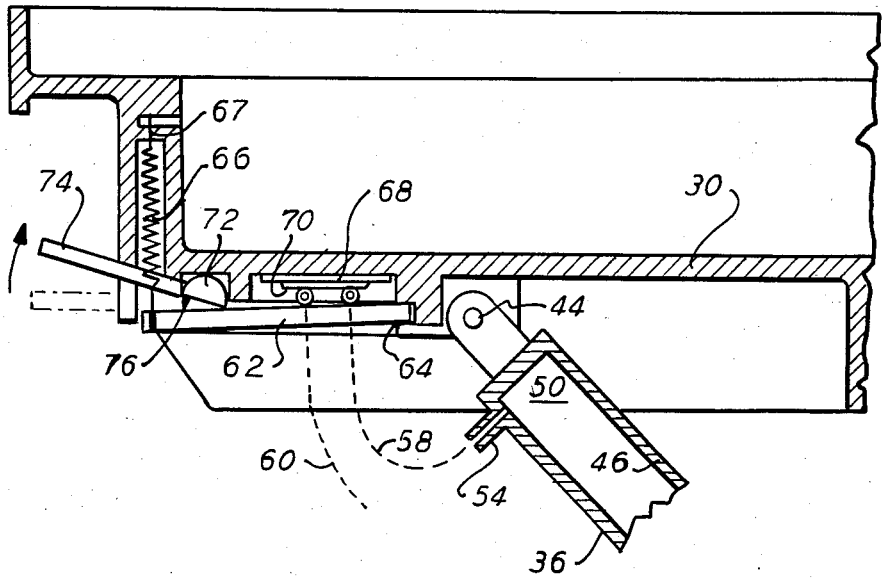
FIG. 3 is a view similar to that of FIG. 2, but displays the valve in an open position.

Turning now to FIG. 3, the valve means is shown in the open position where hydraulic fluid is not thereby prevented from flowing through hydraulic lines 58 and 60. This position is achieved by the operator moving lever arm 74 in the upward direction from the dotted line position to the solid line position. Although the solid line position of FIG. 3 is by an upward movement of the lever arm 74, one of the advantageous features of this invention is that the open position of the valve means can also be achieved by a downward movement exerted by the operator on lever arm 74. Such movement rotates the cylindrical operator 72 and one edge of recess 76 moves downwardly to displace rod 62 downwardly; the recess 76 merely being a flat cut away portion of the cylindrical operator 72.

As rod 62 moves downwardly about its pivot point 64, the hydraulic lines 58 and 60 are no longer pinched between rod 62 and rounded projection 70 of plate 68, thus both hydraulic lines 58 and 60 are opened to the flow of hydraulic fluid and piston 48 (not shown in FIG. 3) is freed to move within the cylinder 46. Thus, in this position of lever arm 74, the operator can tilt the infant bed 30 to the desired tilt angle. Releasing lever arm 74 allows the bias exerted by spring 66 against the free end of rod 62 to move the rod 62 upwardly to close the valve means and return the lever arm 74 to its solid line position.

Figure 4:
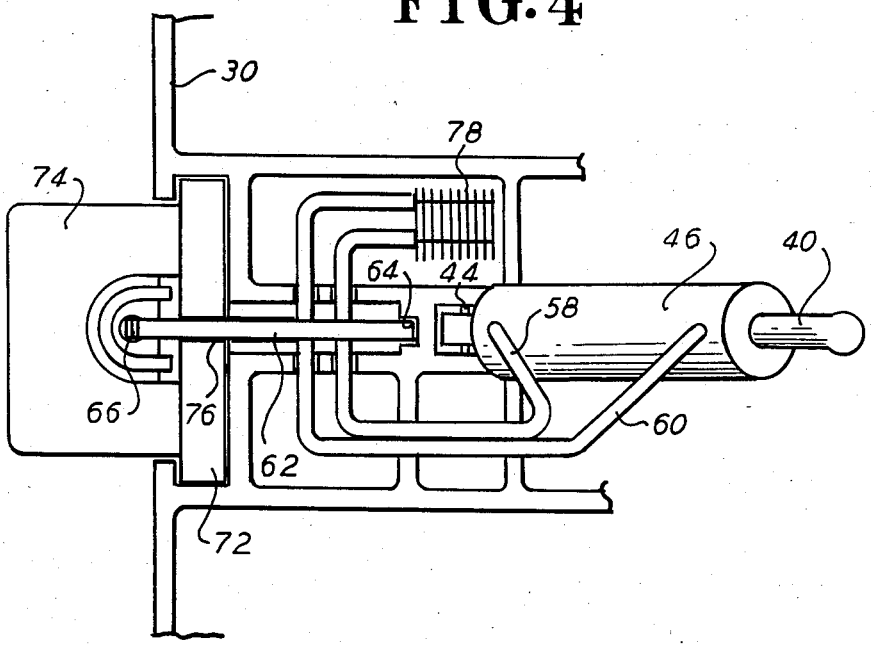
FIG. 4 is a view showing the closed hydraulic circuit used in the present invention.

Turning now to FIG. 4, FIG. 4 shows a view of the bottom of the infant bed 30 and illustrates the closed hydraulic circuit used with the present invention. As can be seen, the hydraulic lines 58 and 60 pass between rod 62 and plate 68 and form a closed hydraulic circuit connecting the variable chambers 50 and 52 at each end of cylinder 46. The cylindrical operator 72 is rotatably mounted to the infant bed 30 at its ends by conventional means, not shown, such as pins. Rod 62 is located within the recess 76 formed in operator 72 and its free end held by spring 66.

A reservoir 78 receives both hydraulic lines 58 and 60 and forms part of the closed hydraulic circuit. Reservoir 78 is a commercially available metallic bellow that allows an increase or decrease in volume of the closed hydraulic circuit as the tilting mechanism is operated and allows for the difference in volumes within variable chambers 50 and 52, the latter of which is taken up partially by piston rod 40.

Returning to FIGS. 1–3, the overall function of the tilting mechanism can now be explained. As the operator or attending personnel desire to adjust the tilt angle of the infant bed 30, the operator need only move the operating lever arm 74 in the upward or downward direction. That movement opens the closed hydraulic circuit so that the hydraulic fluid that fills the variable chambers 50, 52; hydraulic lines 58, 60 and reservoir 78 can move within the closed system. Thus, piston 48 is freed to move within cylinder 46 and the operator can therefore move the infant bed 30 about its pivot point at pin 38 to whatever tilt position is desired with respect to the frame 10.

When the operator has moved the infant bed 30 to the desired tilt position, by merely releasing lever arm 74, the hydraulic lines 58 and 60 are rapidly closed to the flow of hydraulic fluid. Piston 48 can not, therefore, move within cylinder 46 and the infant bed 30 is locked into whatever position the operator has chosen.

Thus, the infant bed is readily tiltable to any position within the limits of the structure conveniently and easily by utilizing a lever arm in easy access and adjust the then freed infant bed to that position. As a convenience, the lever arm 74 can be moved in the upward direction when the operator desires to move the forward end of infant bed 30 in an upward direction and, conversely, the lever arm 74 can be moved downwardly to move the forward end of infant bed 30 downwardly. In either case, once the infant bed 30 is in its desired position, the operator need only release the lever arm 74 to lock the infant bed 30 into that position.

While the present invention has been particularly set forth in terms of specific embodiments thereof, it will be understood in view of the instant disclosure that numerous variations upon the invention are now enabled to those skilled in the art, which variations yet reside within the scope of the instant teaching. Accordingly, the invention is to be broadly construed and limited only by the scope and spirit of the claim now appended hereto.

We claim:

1. An infant care unit comprising:

a standing frame member;

an infant bed tiltably suspended from said frame member and about an axis;

a double acting hydraulic piston assembly forming a movable support between said frame member and said infant bed, said hydraulic piston assembly comprising a cylinder and a piston movable therein, said piston dividing said cylinder into a pair of variable chambers, ports in said cylinder for communicating hydraulic fluid to and from each of said variable chambers, a closed hydraulic circuit connecting said ports to allow hydraulic fluid to pass from one chamber to the other as said piston is moved, and manual valve means located on said infant care unit convenient to an operator, said valve means being selectively operable to permit the movement of hydraulic fluid in said closed hydraulic circuit means to allow tilting of said infant bed and to prevent movement of hydraulic fluid in said closed hydraulic circuit to prevent movement of said piston in said cylinder assembly to fix the tilt position of said infant bed about said axis.

2. An infant care unit as defined in claim 1 wherein said valve means includes a lever arm adapted to be moved in both an upward and downward direction to open said valve means.

3. An infant care unit as defined in claim 1 wherein said valve means is normally closed.

4. Apparatus for changing the tilt angle of an infant bed pivotable about an axis, said apparatus comprising:

a double acting piston assembly having one end fixed remote from the infant bed and having its other end fixed to the infant bed at a point spaced from the pivot axis;

said double acting piston assembly comprising a cylinder and a piston moveable therein; a hydraulic circuit communicating with said cylinder to contain hydraulic fluid for flow to and from said cylinder to control movement of said piston, manual valve means to control the flow of hydraulic fluid in said hydraulic circuit, said valve means located on said infant bed convenient to an operator and being operable to thereby control movement of said piston to pivot the infant bed about the axis.

5. Apparatus as defined in claim 4 wherein said hydraulic circuit includes a variable bellows containing the hydraulic fluid.

* * * * *